US008973550B2

(12) United States Patent
Tuerk et al.

(10) Patent No.: US 8,973,550 B2
(45) Date of Patent: Mar. 10, 2015

(54) OIL SUPPLY DEVICE FOR AN INTERNAL COMBUSTION ENGINE

(75) Inventors: Jens Tuerk, Kemnath (DE); Franco Zemczak, Hersbruck (DE); Mark Zimmermann, Offenhausen (DE); Martin Boehm, Burgthann (DE)

(73) Assignee: MAN Truck & Bus AG, Munich (DE)

( * ) Notice: Subject to any disclaimer, the term of this patent is extended or adjusted under 35 U.S.C. 154(b) by 558 days.

(21) Appl. No.: 13/351,357

(22) Filed: Jan. 17, 2012

(65) Prior Publication Data

US 2012/0180751 A1 Jul. 19, 2012

(30) Foreign Application Priority Data

Jan. 15, 2011 (DE) ..... 10 2011 008 680

(51) Int. Cl.
*F01M 11/03* (2006.01)
*F01M 11/04* (2006.01)

(52) U.S. Cl.
CPC ..... *F01M 11/03* (2013.01); *F01M 11/045* (2013.01)
USPC ..... 123/196 A; 184/6.24; 210/167.02

(58) Field of Classification Search
USPC ..... 123/196 R, 196 A; 184/6.21, 6.24; 210/167.02, 167.04, 167.05
See application file for complete search history.

(56) References Cited

U.S. PATENT DOCUMENTS 7,992,667 B2 * 8/2011 Rennie ..... 210/167.02
2005/0022756 A1 2/2005 Novlan

* cited by examiner

*Primary Examiner* — Noah Kamen
(74) *Attorney, Agent, or Firm* — Laurence A. Greenberg; Werner H. Stemer; Ralph E. Locher

(57) ABSTRACT

An oil supply device for a crankcase of an internal combustion engine feeds oil from a reservoir to a main oil duct of the crankcase. A filter switching device allows a selection from a plurality of oil filter units in the flow path of the oil to be selectively connected into the oil flow path, to set a proportion of the oil filter units to active and a proportion of the oil filter units to passive. A switching unit switches between the active and passive states and opens up a pressurized oil flow path to the active oil filter unit(s) and also a drainage flow path between the passive oil filter unit(s) and a drainage duct. An evacuation device drains or evacuates oil from the drainage duct which has accumulated at the passive oil filter unit(s).

21 Claims, 6 Drawing Sheets

OIL SUPPLY DEVICE FOR AN INTERNAL COMBUSTION ENGINE

CROSS-REFERENCE TO RELATED APPLICATION

This application claims the priority, under 35 U.S.C. §119, of German patent application DE 10 2011 008 680.3, filed Jan. 15, 2011; the prior application is herewith incorporated by reference in its entirety.

BACKGROUND OF THE INVENTION

Field of the Invention

The invention relates to an oil supply device for an internal combustion engine, in particular for a crankcase of an internal combustion engine. The device has at least one oil reservoir and at least one delivery device by way of which oil is conducted from the oil reservoir via at least one flow duct to at least one main oil duct of a crankcase of the internal combustion engine. Multiple oil filter units are provided in the flow path of the oil from the oil reservoir to the at least one main oil duct. Furthermore, a filter switching device is provided by means of which the oil filter units can be selectively connected into the flow path of the oil to the main oil duct such that only one proportion of the oil filter units, as at least one active oil filter unit, is traversed by a flow of the oil, and the other proportion of the oil filter units, as at least one passive oil filter unit, is not traversed by a flow of the oil.

The use of oil supply devices for an internal combustion engine, in particular in conjunction with a crankcase of an internal combustion engine, is already generally known from the fields of automotive engineering, industrial engineering and marine engine construction. The oil supply device is a constituent part of a lubrication system for the internal combustion engine, in which the oil is conducted in the lubricating oil circuit. Specifically, here, an oil pump as a delivery device evacuates the oil out of an oil sump or an oil pan and delivers the evacuated oil via an oil cooler and an oil filter to one or more main ducts in the crankcase, from which the oil is then conveyed to the individual lubricating points. In various applications, there is a demand for operationally important engine components, such as for example an oil filter unit, to be arranged fixedly on the engine in a redundant configuration, thereby making it possible, by correspondingly switching from one oil filter unit to the other, for an oil filter of one oil filter unit to be deactivated and exchanged even during the operation of the internal combustion engine. This is known for example in conjunction with switchable double filters in the field of marine engines. Here, during the exchange of the oil filter of the oil filter unit to be serviced in each case, the residual oil which has accumulated in the oil filter unit is generally drained externally to the engine via a drainage device in conjunction with an aeration/deaeration screw, and the oil filter of the oil filter unit is subsequently dismounted and exchanged.

Such a switchable double filter arrangement is described, for example, in published patent application US 2005/0022756 A1, in which the oil passing from the internal combustion engine is supplied via a supply line to a first filter unit, from which the oil then flows back to the engine again via a first return line. A second filter unit arranged in parallel with the first filter unit is deactivated during the operation of the first filter unit by means of corresponding valves. If it is sought to put the second filter unit into operation, for example in order to service the first filter unit or exchange the oil filter arranged therein, the valves of the first filter unit are closed, and the valves of the second filter unit are correspondingly opened. Specifically, the document concerns an internal combustion engine which is used in conjunction with oil delivery on oil fields, and which is operated here not with conventional fuel but rather with oil.

SUMMARY OF THE INVENTION

It is accordingly an object of the invention to provide an oil supply device for an internal combustion engine which overcomes the above-mentioned disadvantages of the heretofore-known devices and methods of this general type and which provides for an oil supply device for an internal combustion engine, in particular for a crankcase of an internal combustion engine, by way of which an exchange of an oil filter of an oil filter unit is possible in a simple and functionally reliable manner during the operation of the internal combustion engine and by way of which the engine-external draining of residual oil from an oil filter unit to be serviced is avoided to the greatest possible extent.

With the foregoing and other objects in view there is provided, in accordance with the invention, an oil supply device for an internal combustion engine, in particular for a crankcase of an internal combustion engine. The device comprises:

an oil reservoir;

a delivery device configured for conducting oil from the oil reservoir along a flow path to at least one main oil duct of a crankcase of the internal combustion engine;

a plurality of oil filter units disposed in the flow path of the oil from the oil reservoir to the at least one main oil duct;

a filter switching device for selectively connecting respective the oil filter units into the flow path of the oil to the main oil duct, so as to switch only one proportion of the oil filter units to form at least one active oil filter unit to be traversed by a flow of the oil, and to switch another proportion of the oil filter units to form at least one passive oil filter unit not to be traversed by a flow of the oil;

a switching unit connected in the flow path from the oil reservoir to the oil filter units, the switching unit, when the filter switching device is set to switch a proportion of the oil filter units into an active state and another proportion of the oil filter units into a passive state, opening up a first pressurized oil flow path from the oil reservoir to the active oil filter unit and also forming a second drainage flow path between the passive oil filter unit and a drainage duct, with the drainage duct being assigned a drainage device for draining the oil that has accumulated in a region of the passive oil filter unit. In a preferred embodiment, the drainage device is a suction device configured for evacuating the oil from the passive oil filter unit.

In other words, there is provided, in accordance with the invention, an oil supply device for an internal combustion engine, in particular for a crankcase of an internal combustion engine, which crankcase has at least one oil reservoir and at least one delivery device, by means of which delivery device oil is conducted from the oil reservoir via at least one flow duct to at least one main oil duct of a crankcase of the internal combustion engine, wherein multiple oil filter units, for example multiple oil filter units equipped with in each case at least one oil filter, are provided in the flow path of the oil from the oil reservoir to the at least one main oil duct. Furthermore, the oil supply device comprises a filter switching device, for example in the form of a shuttle valve or the like, by means of which filter switching device the oil filter units can be selectively connected into the flow path of the oil to the main oil duct such that only one proportion of the oil filter units, as at least one active oil filter unit, is traversed by a flow of the oil, while the other proportion of the oil filter units, as at least one passive oil filter unit, is not traversed by a flow of the oil and can if appropriate be serviced. It is proposed according to the invention that, in the flow path from the oil reservoir to the oil filter units, there is provided a switching unit, preferably a single switching unit, which, in at least one proportion of those switching positions of the filter switching device in which one proportion of the oil filter units is switched into an active state and another proportion of the oil filter units is switched into a passive state, opens up a first pressurized oil flow path from the oil reservoir to the at least one active oil filter unit and also produces a second drainage or evacuation flow path between the at least one passive oil filter unit and a drainage duct, wherein the drainage duct is assigned a drainage device, in particular an evacuation device, by means of which the oil which has accumulated in the region of the at least one passive oil filter unit can be drained, in particular evacuated.

With such a design according to the invention, it is possible to carry out an oil filter exchange of the deactivated, passive oil filter unit even while the internal combustion engine is running, specifically without it being necessary for residual oil which has collected in the passive, deactivated oil filter unit to be drained externally to the engine. This is because, as a result of the provision according to the invention of a drainage device, it is possible for the oil which has accumulated in the deactivated, passive oil filter unit to be drained or evacuated in an extremely simple manner and supplied to the lubricating oil circuit of the internal combustion engine. Here, it is preferably provided that the drainage duct is assigned to the oil reservoir, for example an oil pan or the like, which forms a constituent part of a crankcase of the internal combustion engine, such that the oil which has been drained, in particular evacuated, via the drainage duct is received in the oil reservoir again, and can thus be supplied to the lubricating oil circuit of the internal combustion engine by means of the oil supply device. At this juncture it is pointed out that the expression "crankcase" is to be understood here expressly in a broad sense, and may for example also be considered to equate to the expression "engine block."

The provision of an evacuation device as a drainage device is therefore necessary in particular in order to be able, for the drainage of the oil, to build up an adequate pressure potential against unfavorable pressure conditions in the region of the crankcase during the operation of the internal combustion engine. Here, the evacuation device may be formed in some other way, for example by means of any suitable evacuation pump. An embodiment is however particularly preferable in which the drainage duct formed as an evacuation duct is assigned an ejector pump device as an evacuation device, by means of which the oil which has accumulated in the region of the at least one passive oil filter unit can be evacuated via the evacuation duct, wherein, to generate an evacuation pressure, the ejector pump device can be acted on with a pressurized oil partial flow branched off from the pressurized oil flow path. With such a jet pump arrangement, it is thus ensured in a particularly simple and functionally integrated manner that a partial flow, branched off from the pressurized oil flow path, from the engine pressurized oil supply which must be provided in any case is simultaneously used, in a dual function, as a driving medium for the ejector pump device, in order, in a corresponding switching position of the switching unit, to evacuate as evacuation medium the residual oil which has accumulated in the at least one passive oil filter unit. It is thus advantageously possible here, within the lubricating oil circuit, to simultaneously also ensure the evacuation by means of the ejector pump device in a simple and functionally reliable manner without a large amount of additional component outlay.

Here, the ejector pump device may basically be formed by a permanent ejector pump which is permanently actuated during the operation of the internal combustion engine, or else alternatively by an ejector pump which can be actuated and/or activated at defined times by means of an actuating device. Here, the actuating device may basically be designed and arranged such that a manual actuation is possible. Particularly preferable, however, is an actuating device formed by a control device, which can be activated correspondingly at defined times for the actuation of the ejector pump device. This will be discussed in greater detail below in conjunction with a preferred physical embodiment of the switching unit.

The switching unit itself may basically take various forms. Particularly preferable is a switching unit which has an adjusting device which is held in a switching housing of the switching unit so as to be adjustable, wherein the oil filter flow ducts which lead to the oil filter units open into the switching housing and, there, in defined switching positions of the adjusting device, communicate either with the drainage or evacuation duct or with the pressurized oil flow duct which proceeds from the delivery device and which likewise opens into the switching housing. It is self-evident that yet further switching positions are basically also possible, as will also be explained in greater detail below.

The switching positions just described here are substantially those switching positions in which preferably an evacuation of residual oil out of at least one passive, deactivated oil filter unit should be possible by means of the drainage or evacuation device. Further switching positions are self-evidently always possible. The adjusting device itself may likewise take different forms, for example may be a switching slide or the like. It is however particularly preferable for the adjusting device to take the form of a switching drum which is held and mounted in a switching housing of the switching unit so as to be rotatable. By means of a switching drum of said type, it is possible by means of simple rotational movements for the individual control ducts on the switching drum, as will be explained in greater detail below, to be placed in flow-connection with the correspondingly assigned pressurized oil flow ducts or oil filter flow ducts.

In a particularly preferred physical embodiment, it is proposed that, in a first switching position of the switching unit, the adjusting device, in particular a switching drum, connects at least one first oil filter flow duct, which leads to at least one active first oil filter unit, to a pressurized oil flow duct by means of a control duct, while in said first switching position of the switching unit, at least one second oil filter flow duct, which leads to at least one passive second oil filter unit, is flow-connected to the drainage or evacuation duct by means of a control duct. If it is then sought to switch the at least one second oil filter unit into an active state, the adjusting device, in particular a switching drum, is moved into a second switching position in which, with the at least one second oil filter unit active and the at least one first oil filter unit passive, the at least one second oil filter flow duct, which leads to the active second oil filter unit, is flow-connected to a pressurized oil flow duct by means of a control duct, while the at least one first oil filter flow duct, which leads to the at least one passive first oil filter unit, is flow-connected to the drainage or evacuation duct by means of a control duct. With such control ducts of an adjusting device, in particular of a switching drum, it is possible in a simple manner to obtain different flow guidance merely by switching or moving the adjusting device, without it being necessary for this purpose to use valves or the like which require high component outlay. Furthermore, such an adjusting device, in particular a switching drum, which is held or mounted in a switching housing is very functionally reliable in terms of its actuation and operation, as a result of which both the pressurized oil delivery to the active oil filter unit and also the facility for the drainage or evacuation of the residual oil from the other oil filter unit switched into a passive state are ensured.

As already stated above, the embodiment of the adjusting device as a switching drum is particularly preferable. In this context, in the case of an adjusting device which has multiple control ducts and is designed as a switching drum, it may also be provided that said adjusting device has two control ducts which, in the first switching position, are arranged such that a first control duct connects the pressurized oil flow duct to the first oil filter flow duct while a second control duct connects the second oil filter flow duct to the drainage duct. In the second switching position, said control ducts are then preferably arranged such that the first control duct connects the first oil filter flow duct to the drainage duct while the second control duct connects the second oil filter flow duct to the pressurized oil flow duct. This results in an advantageous design in which one control duct can basically be used for different flow connections. It is self-evident that more than said two flow ducts or flow-connection facilities may be provided in the region of such a switching drum, for example in order to form other flow connections. In conjunction with the facility, provided according to the invention, for the drainage of a passive, deactivated oil filter unit during the operation of the internal combustion engine and therefore while a further oil filter unit is simultaneously active, such a physical design however yields an advantageous physical embodiment of a switching unit which can be realized in a simple and functionally reliable manner.

The evacuation device, which is formed by an ejector pump device, is preferably arranged in the switching housing and, at the switching housing side, is flow-connected to the evacuation duct, which at least in regions forms a constituent part of the switching housing, in particular is flow-connected to said evacuation duct in such a way that a nozzle of the ejector pump device projects into the evacuation duct.

In a further particularly preferred embodiment, it is provided that a branch duct branches off from a flow duct which forms the pressurized oil flow path, in particular from a flow duct or flow duct portion, which leads from the delivery device to the switching unit, of the pressurized oil flow path, which branch duct opens into the ejector pump device, preferably in the region of a nozzle of the ejector pump device. With such a design, the pressurized oil supply for the ejector pump device can be ensured in a functionally reliable manner.

Here, a configuration is particularly preferable in which the branch duct runs at least in regions in the switching housing, whereby the functional integration in conjunction with the switching unit can be increased yet further, and said switching unit can be constructed as a modular component which is simple to manufacture. The branch duct may however if appropriate also be formed separately from and independently of the switching housing, for example by a hose and/or pipe line which branches off from a pressurized oil flow duct.

It is also preferably provided that, in the region of the branch duct, there is provided a switchable cut-off device, in particular a cut-off valve or the like, as a cut-off element, which can be switched between positions in which it opens up or closes off the flow connection to the ejector pump device. Here, the switching of the cut-off device may basically also be carried out manually. It is however particularly preferable for the switching to be carried out by means of a control device as a function of defined cut-off parameters.

Also particularly preferable is an embodiment according to the invention in which the cut-off device is coupled to the adjusting device, in particular to a switching drum, of the switching unit in such a way that, at defined switching positions of the adjusting device or of the switching drum, said cut-off device can be placed into its positions for opening up or closing off the flow connection to the ejector pump device. That is to say that, with such a design, the adjusting device can then be moved into the desired position as a function of an actuation of the switching unit. By means of this coupling of the cut-off device to the adjusting device of the switching unit, it is thus ensured in a simple manner that, in a defined switching position of the adjusting device, the cut-off device is situated in the desired position for opening up or closing off the flow connection to the ejector pump device. In this context, it should be expressly mentioned that the adjusting device, which is formed in particular by a switching drum, may also be designed and/or adjustable such that, during the operation of the internal combustion engine, said adjusting device can be adjusted into a position in which one proportion of the oil filter units is switched into an active state and another proportion of the oil filter units is switched into a passive state, and in which furthermore the evacuation device is not activated, in particular even in the case of a flow connection possibly being produced between the at least one oil filter unit and the evacuation duct. In other words, this means that the adjusting device and therefore the switching unit may self-evidently also be designed such that the adjusting device may also be moved into positions in which—despite a proportion of the oil filter units being in an active state and despite another proportion of the oil filter units being in a passive state—evacuation does not imperatively take place or is not imperatively provided. That is to say that, in addition to the switching positions described above which permit the evacuation of an oil filter unit switched into a passive state, other switching positions with oil filter units switched into active and/or passive states are self-evidently also possible.

At this juncture, it is expressly also mentioned that the actuation of the evacuation device, which is formed in particular by an ejector pump device, may self-evidently also be realized in some other way, that is to say independently of the switching position of the switching unit, for example by means of magnetic and/or electric switching devices, which may be actuated separately from and independently of an actuation of the switching unit.

In this context, it should also be mentioned that the adjusting device, in particular a switching drum, may be designed and/or arranged, in particular with regard to its control ducts, such that, when the internal combustion engine is at a standstill and therefore also when the delivery device is deactivated, the adjusting device can be adjusted into a position in which it produces a flow connection between the evacuation duct and an associated oil filter unit, such that oil which has accumulated in the respective oil filter unit can flow out of the latter under the force of gravity via the drainage or evacuation duct, in particular can flow out via the evacuation duct into an oil reservoir of the crankcase. To permit such a gravity-induced outflow, the oil filter units should preferably be arranged geodetically above the switching unit in the assembled state.

To ensure functional operation for example even in the event of maloperation of the internal combustion engine in which all the filter units are switched into an active state, the adjusting device, in particular a switching drum, is designed and/or adjustable, in particular with regard to its control ducts, such that all of the oil filter units can be switched into an active state and traversed by a flow of oil.

Also particularly preferable is an embodiment in which at least one main oil filter unit is provided which, with further components of the oil supply device or of the lubricating oil circuit, such as for example an oil cooler and/or a blow-by separator and/or an oil pump as a delivery device and/or if appropriate other components integrated into the lubricating oil circuit, is integrated into an oil module which can be constructed separately, whereas in contrast the at least one oil filter unit which forms a redundancy is formed as a separately assemblable additional filter unit.

With the above and other objects in view there is also provided a method for operating an oil supply device for an internal combustion engine, in particular for a crankcase of an internal combustion engine, having one or more features of the oil supply device according to the invention as described in detail herein.

Other features which are considered as characteristic for the invention are set forth in the appended claims.

Although the invention is illustrated and described herein as embodied in an oil supply device for an internal combustion engine, in particular for a crankcase of an internal combustion engine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE INVENTION

Figure 1A:
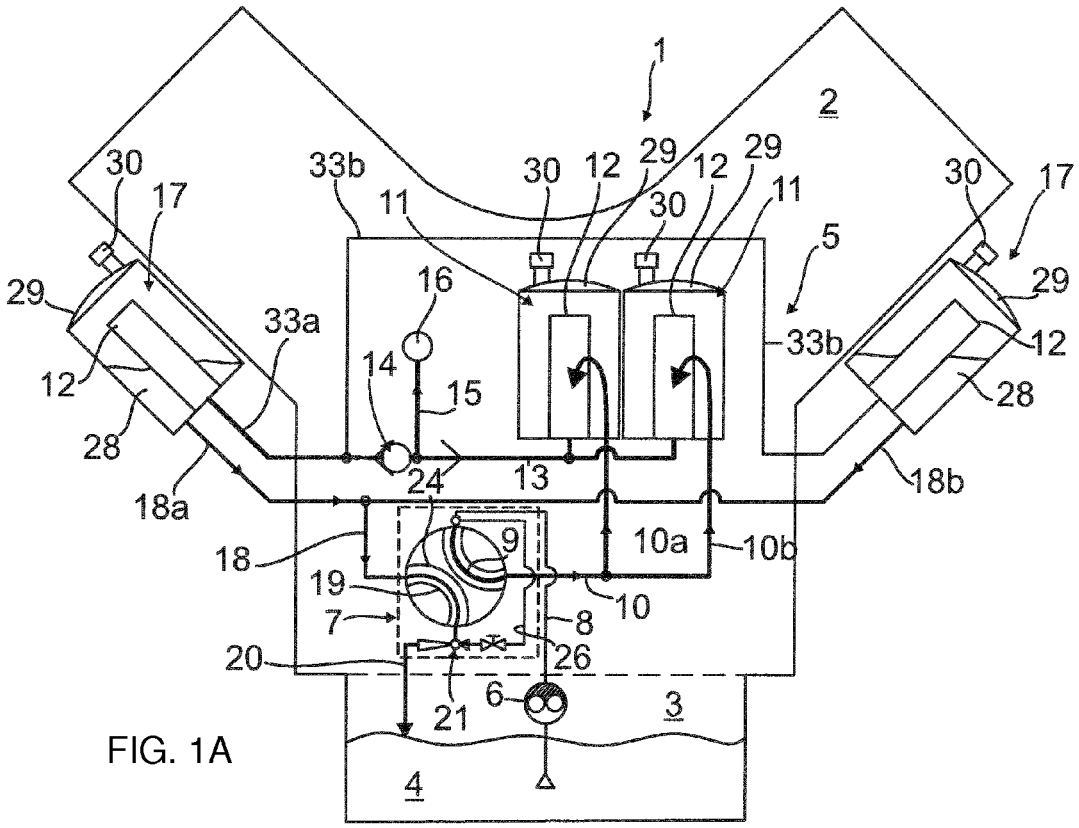
FIG. 1A schematically shows a diagrammatic illustration of a crankcase of an internal combustion engine having an oil supply device according to the invention, which oil supply device is in a switching position in which residual oil is evacuated from an oil filter unit and pressurized oil can be conveyed via a further oil filter unit to a main oil duct of the crankcase.

Referring now to the figures of the drawing in detail and first, particularly, to FIG. 1A thereof, there is shown a schematic view of a crankcase 1 of an internal combustion engine, which in this case has by way of example a cylinder block 2 in a V arrangement, in which cylinder pistons and valves are guided and mounted in the conventional way, though this is not illustrated here. The lower portion of the crankcase 1 in the plane of the drawing of FIG. 1A has in this case an oil pan 3 which forms an oil reservoir and in which is accommodated lubricant, referred to as oil 4, which is supplied by means of an oil supply device 5 according to the invention to a lubricating oil circuit not illustrated in detail here.

By means of an oil pump 6, oil is conveyed or pumped, as pressurized oil, from the oil pan 3 via a pressurized oil flow duct 8 to a switching unit 7 which will be described in more detail below. In the switching unit 7, the pressurized oil flows through a first control duct 9 which is flow-connected to an oil filter flow duct 10 which leads away from the switching unit 7. Said oil filter flow duct 10 branches into a first duct portion 10*a* and a second duct portion 10*b*, which duct portions lead to in each case one oil filter unit 11 in which the pressurized oil flows through an oil filter 12 (illustrated here merely in highly schematic form) before flowing via a further pressurized oil flow duct 13 to a filter switching device designed here for example as a shuttle valve 14, which in this case enables the flow of the pressurized oil from the pressurized oil flow duct 13 to a main oil duct 16 via a duct portion 15 which leads away from the shuttle valve 14.

As can also be seen from the schematic illustration of FIG. 1, the oil supply device also comprises two second oil filter units 17 in addition to the two first oil filter units 11, which second oil filter units are flow-connected to a second control duct 19 of the switching unit 7 via an oil filter flow duct 18 and via duct portions 18*a*, 18*b* which branch off from said oil filter flow duct and which lead to in each case one of the second oil filter units 17. The second control duct 19 is also flow-connected to an evacuation duct 20 which is assigned to or opens into the oil pan 3.

Figure 1B:
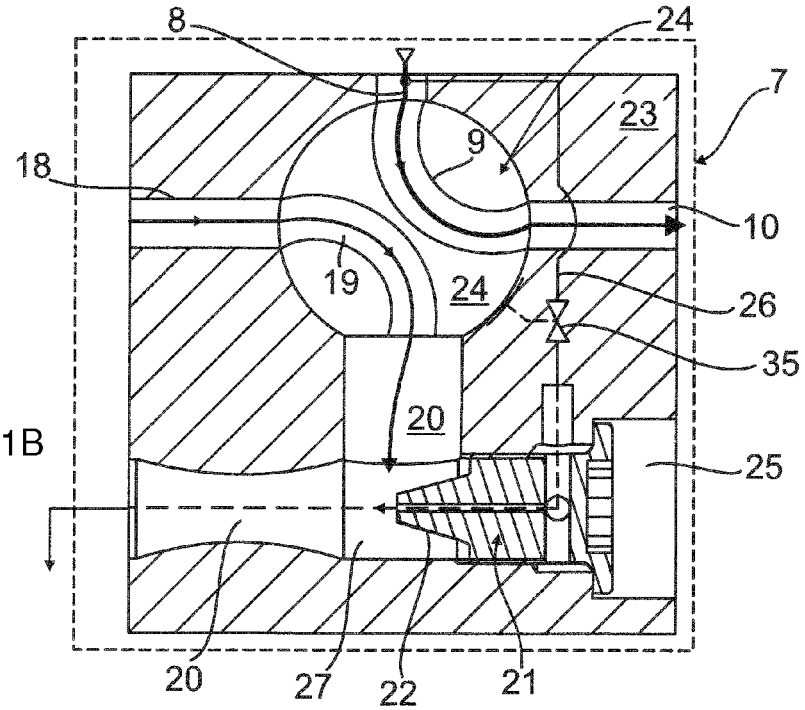
FIG. 1B schematically shows an enlarged diagrammatic illustration of a switching unit of FIG. 1A.

The evacuation duct 20 is assigned an ejector pump 21, or suction pump 21, which, as can be seen in particular from FIG. 1B, which shows an enlarged illustration of the switching unit 7 from FIG. 1A, opens with a nozzle 22 into the evacuation duct 20 which proceeds from the second control duct 19. As can be seen in particular from FIG. 3, the switching unit 7 comprises a switching housing 23 which is shown in partial section and in which is a switching drum 24, which has the control ducts 9, 19 and which will be described in more detail below, is held so as to be rotatable. Furthermore, in said switching housing 23, the ejector pump 21 is mounted in the region of the evacuation duct 20 in a pump recess 25, in such a way that the nozzle 22 of the ejector pump 21 projects in the manner described above into the switching-housing-side region of the evacuation duct 20. The expression "evacuation duct" should therefore be understood here in a broad sense, and encompasses both the switching-housing-side duct portion and also the duct portion which runs outside the switching housing 23, as can be seen for example in FIG. 1A.

At this juncture, it is furthermore expressly pointed out that the expression "flow duct" should likewise be understood in a broad sense and encompasses both free lines, formed for example by pipes or hoses, and also ducts or the like which are integrated into or formed in the components.

As can also be seen schematically and in diagrammatic form in particular from FIG. 1B, a branch duct 26 branches off from the pressurized oil flow duct 8 upstream of the switching unit 7 and, here, leads either integrally in the switching housing 23 of the switching unit 7, or else by means of a separate line outside the switching housing 23 of the switching unit 7, to the ejector pump 21, such that pressurized oil is picked off in the form of a partial flow from the pressurized oil flow duct 8 in a way yet to be described in more detail, and can be supplied as driving medium to the ejector pump 21. Said partial flow of the pressurized oil which is branched off from the pressurized oil flow duct 8 is then injected via the nozzle 22, which may have for example a nozzle size of between 1 and 5 mm (depending on the engine size, the throughflow rates etc.), into the mixing chamber portion 27, which adjoins the nozzle 22 in the downstream direction, of the evacuation duct 20, where said pressurized oil imparts, via the second control duct 19, a suction effect in the oil filter flow duct 18 flow-connected to the second oil filter units 17, or in the duct portions 18*a* and 18*b* of said oil filter flow duct. In this way, it is then possible, in the position of the shuttle valve 14 shown in FIG. 1A, in which only the first oil filter units 11 are switched into an active state and the second oil filter units 17 are in contrast switched into a passive state or are deactivated, for a residual oil quantity 28 situated in the second oil filter units 17 to be evacuated, for example in the event of servicing work, from the second oil filter units 17, of which there are by way of example two, and to be introduced into the oil pan 3 of the crankcase 1 via the duct combination 18, 18*a*, 18*b* and the second control duct 19 and the evacuation duct 20. For access into the interior of the oil filter units, these may have a cover 29 together with a deaeration/aeration screw 30, which can be handled or actuated in the conventional way during a filter exchange. With such a design, it is thus ensured that the oil filters 12 of the second oil filter units 17 can be exchanged even during the operation of the internal combustion engine and of the first oil filter units 11, without it being necessary for the residual oil quantity 28 which has accumulated in the second oil filter units 17 to be drained externally to the engine. Oil losses are therefore reduced considerably by means of this solution according to the invention.

Figure 1C:
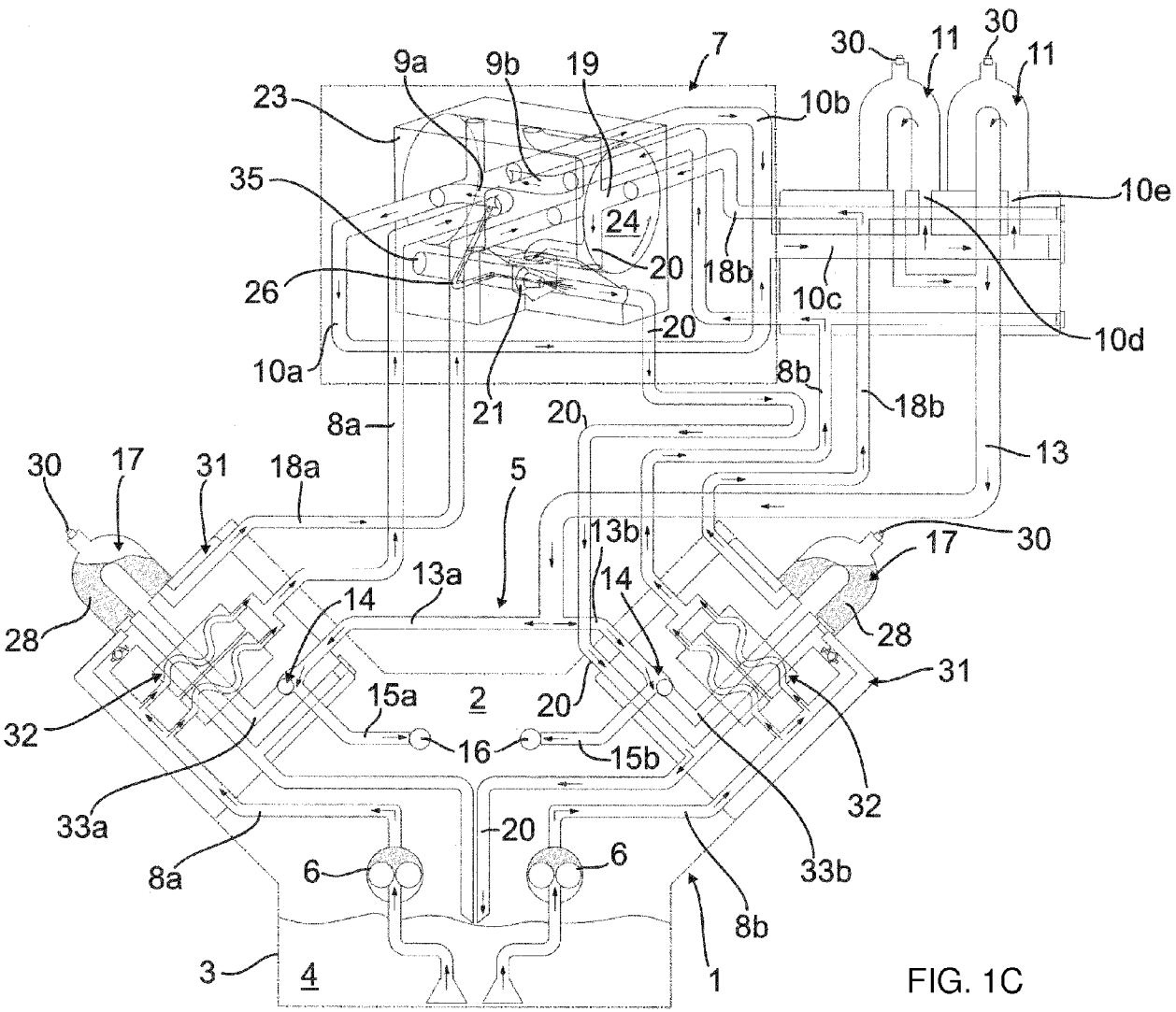
FIG. 1C schematically shows an oil supply device in a switching position corresponding to FIGS. 1A and 1B, with a perspective detail illustration of the switching unit which has a switching drum.

FIG. 1C shows this basic design and this basic method implementation once again, now in a slightly modified form. In particular, it can be seen from the illustration of FIG. 1C that the second oil filter units 17 are in this case a constituent part of a so-called oil module 31, which aside from the oil filter unit 17 also comprises an oil cooler 32 (illustrated here merely schematically) and if appropriate other components or parts which form a constituent part of the lubricating oil circuit. Said oil modules 31 are then fixedly installed on the engine in a manner known per se. A further difference is that, here, two oil pumps 6 are provided as delivery devices, which oil pumps are assigned to in each case one pressurized oil flow duct 8*a* and 8*b* respectively which lead to the switching unit 7. In the switching position of the switching drum 24 of the switching unit 7 shown in FIG. 1C, the two pressurized oil flow ducts 8*a*, 8*b* are flow-connected to in each case one correspondingly assigned control duct 9*a* (pressurized oil flow duct 8*a*) and 9*b* (pressurized oil flow duct 8*b*), which control ducts 9*a*, 9*b* are furthermore flow-connected to a pressurized oil flow duct 10*a* and 10*b* respectively, which subsequently merge to form a pressurized oil flow duct 10*c*, which in turn splits into partial flow ducts 10*d* and 10*e* to in each case one first oil filter unit 11.

After flowing through the first oil filter units 11, the pressurized oil flows via the pressurized oil flow duct 13, again via the portions 13*a*, 13*b* and 15*a* and 15*b*, to the in this case two main oil ducts 16, wherein here, by way of example, each oil module 31 is assigned a shuttle valve 14 which opens up the flow path from the pressurized oil flow duct 13 to the in this case two main oil ducts (16).

At the other side, each of the two second oil filter units 17, switched in this case into a passive state by means of the shuttle valve 14, are flow-connected via the flow ducts 18*a* and 18*b* to a further control duct 19 of the switching drum 24, which control duct 19 is flow-connected to a portion of the evacuation duct 20 in the switching housing. Here, too, the ejector pump 21 again opens into said evacuation duct 20 and is acted on with a partial flow of the pressurized oil via the branch duct 26 which in this case branches off from the pressurized oil flow duct 8*a*, as a result of which a suction effect is imparted to the residual oil quantities 28 that have accumulated in the region of the second oil filter units 17, and said residual oil quantities are evacuated, and finally introduced into the oil pan 3, via the flow ducts 18*a*, 18*b* and the evacuation duct 20, counter to the pressure conditions prevailing in the crankcase 1.

Figure 1D:
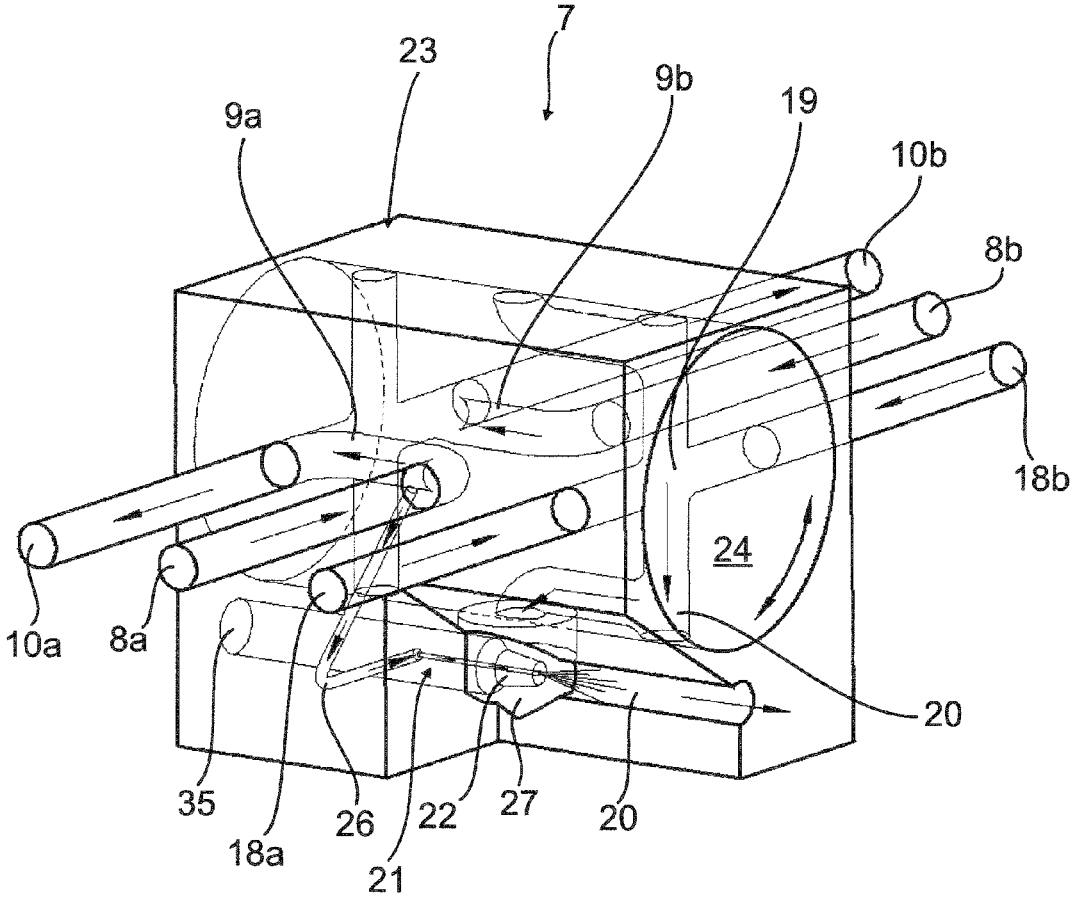
FIG. 1D shows the switching unit of FIG. 1*c* in an enlarged detail illustration.

In FIG. 1D, the switching unit 7 illustrated in FIG. 1C is shown on an enlarged scale, such that individual details can be more clearly seen.

Figure 2A:
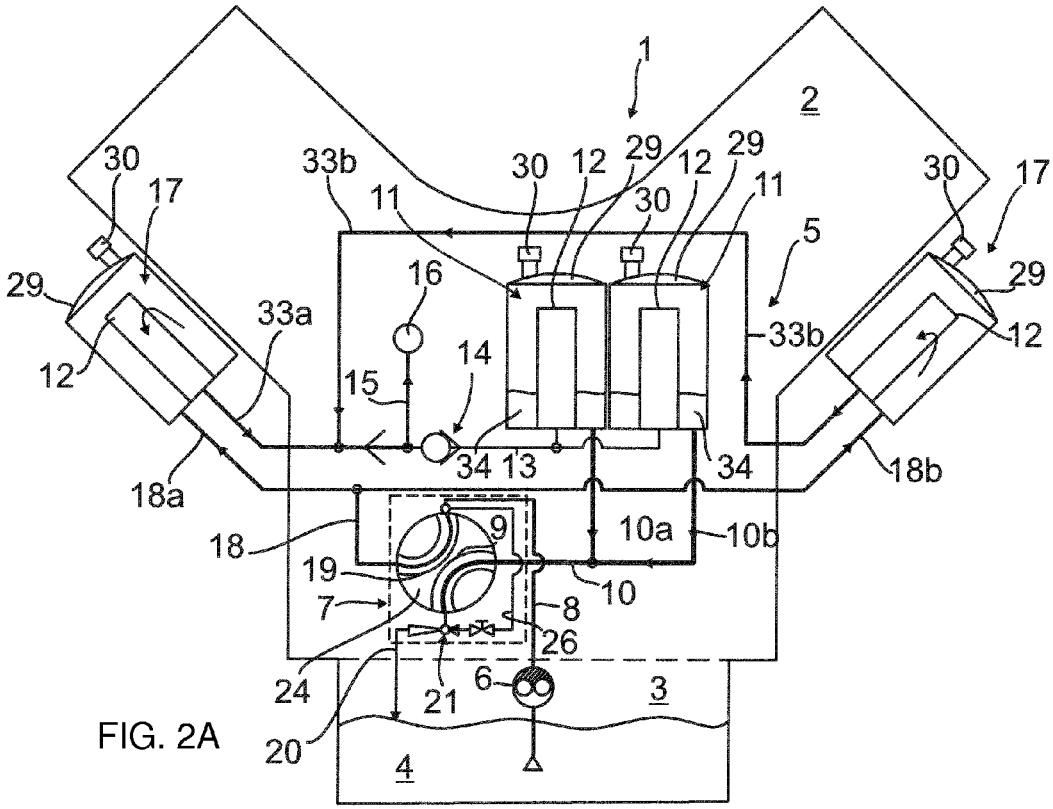
FIG. 2A shows an illustration corresponding in principle to FIG. 1A, but with the switching unit in a different switching position.

If, proceeding from the exemplary illustration of FIG. 1A, the shuttle valve 14 which forms a filter unit switching device is now switched, the two second oil filter units 17 are switched into an active state (FIG. 2A). As a result, the pressurized oil flowing through the two oil filter units 17 can be conveyed via the pressurized oil flow ducts 33*a* and 33*b*, which lead away from the second oil filter unit 17, and via the duct portion 15 into the main oil duct 16. To ensure that the two oil filter units 17 can be supplied with a flow of pressurized oil, it is preferably provided that, at the same time as the shuttle valve 14 is switched, the switching drum 24 of the switching unit 7 in the switching housing 23 is also rotated such that the second control duct 19 then produces a flow connection between the pressurized oil flow duct 8 and the oil filter flow duct 18, such that the pressurized oil can flow via the two duct portions 18*a* and 18*b* into the associated second oil filter units 17, and from there onward, in the manner described above, via the flow ducts 33*a* and 33*b* to the main oil duct 16. At the same time, as a result of the rotation of the switching drum 24, the first control duct 9 is placed in flow-connection at one side with the evacuation duct 20 and at the other side with the oil filter flow duct 10, which opens with its two duct portions 10*a*, 10*b* into the first oil filter unit 11. Accordingly, with the ejector pump 21 activated, a suction effect can be imparted to a residual oil quantity 34 in the two first oil filter units 11 switched into a passive state, as a result of which said residual oil quantity 34 is conveyed into the oil pan 3 via the duct combination 10, 10*a*, 10*b*, the first control duct 9 and the evacuation duct 20. As already explained above in conjunction with the switching position of the embodiment according to FIGS. 1A to 1D, the ejector pump 21 in this case works against the pressure conditions prevailing in the crankcase, that is to say the ejector pump 21 builds up a pressure potential against unfavorable pressure conditions in the crankcase space in order to permit the evacuation of the residual oil quantity 34 from the two first oil filter units 11.

Figure 2B:
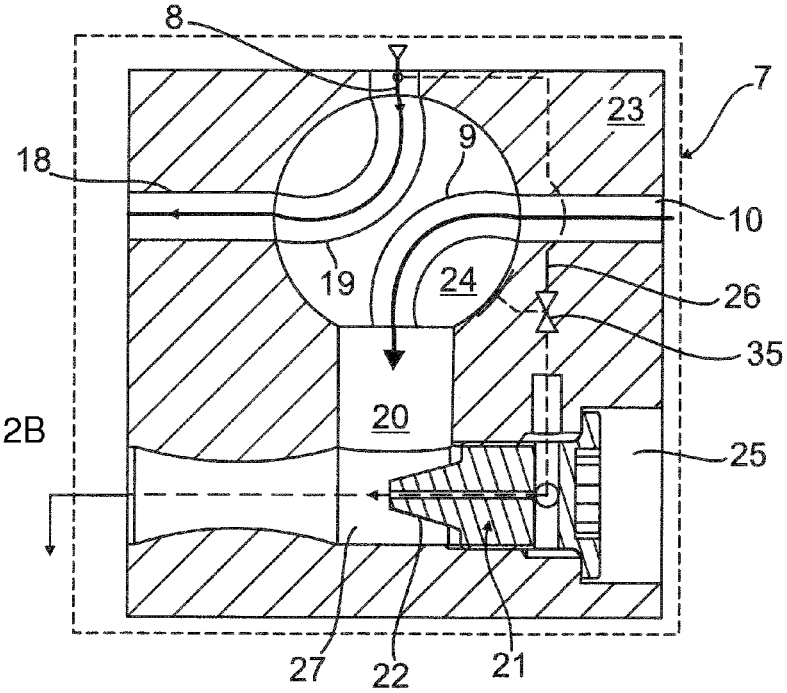
FIG. 2B shows an enlarged illustration of the schematic diagrammatic illustration of the switching unit of FIG. 2A.

As can be seen in particular from FIG. 1B and also from FIG. 2B, there is provided in the region of the branch duct 26 a cut-off element formed by way of example by a cut-off valve 35, by means of which the branching of pressurized oil from the pressurized oil flow duct 8 to the ejector pump 21 can be enabled or blocked depending on the switching position of the cut-off valve 35. In the open state of the valve 35, the evacuation of the residual oil quantity from the oil filter units switched into a passive state in each case can be effected depending on the switching position of the switching drum 24. In contrast, when the cut-off valve 35 is in its cut-off position, during the operation of the internal combustion engine, there is generally no flow of the residual oil quantity out of the oil filter units switched into a passive state, because in this case there is insufficient evacuation pressure or suction acting on the residual oil quantities in the oil filter units switched into a passive state.

For the actuation of the cut-off valve 35, it may be provided that, for example when servicing work is carried out, said cut-off valve is actuated manually. Alternatively, it may however also be provided that the cut-off valve 35 is switched into the open position in a manner correspondingly controlled by means of a control device of the oil supply device 5. In a particularly preferred embodiment, it is provided that the cut-off valve 35 is switched into its open position when the switching drum 24, at a certain switching drum position as illustrated in FIGS. 1B and 2B, simultaneously also actuates the cut-off valve 35 in order to adjust the latter between an open and a closed position depending on the switching position of the switching drum 24.

Figure 3:
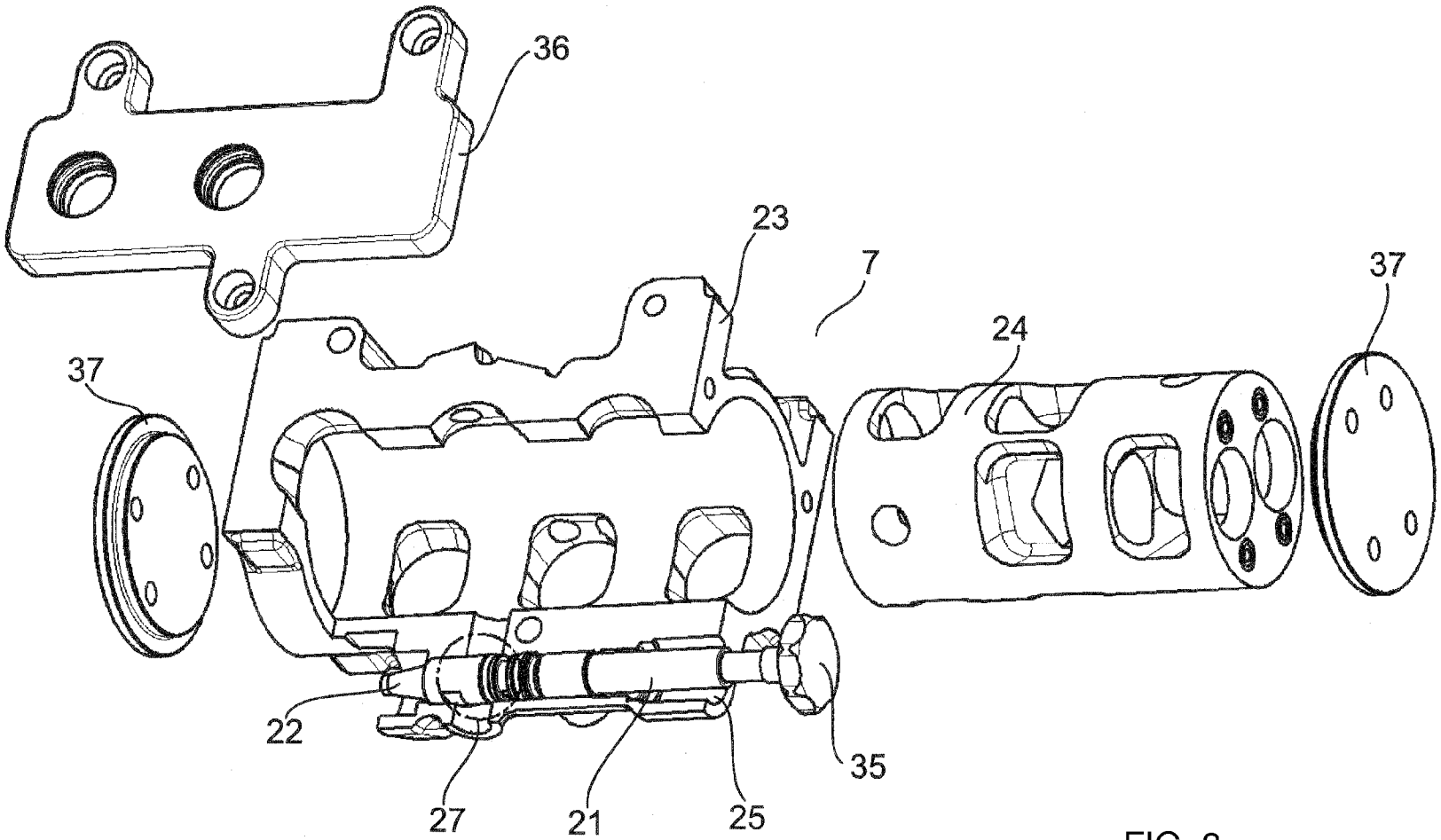
FIG. 3 schematically shows a perspective exploded illustration of the construction of the switching unit from a switching housing and switching drum.

Here, the reference numeral 35 in FIGS. 1C and 1D serves to merely symbolically indicate that a cut-off valve 35 may be arranged in the pump recess 25 in the manner shown in FIG. 3.

As already discussed above, the switching of the switching drum 24 and therefore of the switching unit 7 may take place separately from and independently of an adjustment or switching of the shuttle valve 14. However, a coupling of the switching of the shuttle valve 14 and switching unit 7 is basically also possible here.

Figure 2C:
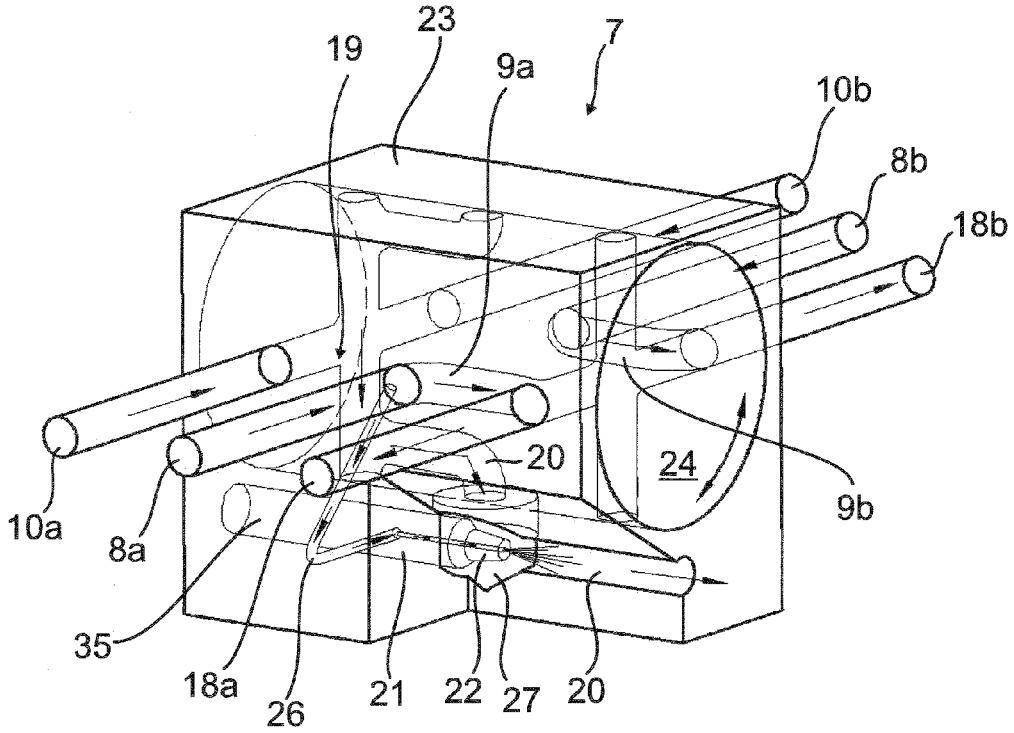
FIG. 2C shows schematically and perspectively an enlarged detail illustration of the switching unit according to the invention in a switching position shown in FIGS. 2A and 2B.

FIG. 2C now illustrates, once again for said switching situation explained in conjunction with FIGS. 2A and 2B, a switching unit 7 which is a constituent part of the oil supply device 5 as per the embodiment of FIG. 1C. As can be seen from the illustration of FIG. 2C, the control ducts 9*a* and 9*b* have, as a result of rotation of the switching drum, been correspondingly moved or replaced with control ducts of the switching drum 24 which now produce a flow connection between the pressurized oil flow duct 8*a* and the oil filter flow duct 18*a*. The same applies analogously to the control duct 9*b*, which now connects the pressurized oil flow duct 8*b* to the oil filter flow duct 18*b*. The oil filter flow ducts 10*a* and 10*b*, which in this case are assigned to the side switched into a passive state, are now flow-connected via a control duct 19 to the evacuation duct 20. The design otherwise corresponds to that described in conjunction with FIG. 1C, with the difference that a residual oil quantity is now evacuated via the evacuation duct 20 from the two oil filter units 11, and the pressurized oil flows via the oil filter units 17 to the main oil ducts 16.

Aside from the embodiments illustrated here, in which the evacuation of a residual oil quantity is permitted in each case from the oil filter units switched into a passive state, the switching unit 7 may self-evidently additionally also be designed, in particular with regard to its control ducts, such that in defined switching positions, a control duct assigned to the pressurized oil side is assigned to an oil filter unit switched into an active state, whereas the oil filter unit switched into a passive state is not assigned a control duct on the switching drum, and accordingly no flow connection is provided between said oil filter unit and the evacuation duct either. Such a switching drum design or such an arrangement design is not illustrated here, but is basically possible and constitutes a further switching possibility or a further possible configuration, in addition to the switching positions described above, of the switching drum and therefore of the switching unit.

The switching drum 24 in conjunction with its control ducts may likewise be designed such that, for example in the event of erroneous switching, all the oil filter units are switched into an active state and are supplied with oil. This situation is also not explicitly illustrated here.

Finally, in the case of a correspondingly geodetically upper arrangement of the oil filter units, as illustrated in FIGS. 1A and 2A, it is also possible to permit drainage of the respective residual oil quantity via the evacuation duct 20 when the engine is at a standstill, specifically under the force of gravity without the activation of the ejector pump 21.

It may or should be possible for all of said switching states to be realized by means of an oil supply device according to the invention, such that an oil supply device which is of functionally integrated, simple overall design is obtained in this way.

As can be seen in particular from FIG. 3, the switching housing 23 itself may be of multi-part design, which is illustrated there merely by way of example by means of a plate 36 and a cover 37. Also, the openings of the switching drum 24 are shown here merely schematically without the control ducts running in the interior, wherein the different opening sizes are intended to symbolize the manifold configuration and switching variants of the control ducts or of the switching drum 24. Furthermore, FIG. 3 shows the cut-off valve 35 which can be actuated here by way of example manually, and which can be placed into the desired position by being rotated.

The switching unit 7 may then be of modular construction.

The invention claimed is:

1. An oil supply device for an internal combustion engine, comprising:

an oil reservoir;

a delivery device configured for conducting oil from said oil reservoir along a flow path to at least one main oil duct of a crankcase of the internal combustion engine;

a plurality of oil filter units disposed in the flow path of the oil from said oil reservoir to the at least one main oil duct;

a filter switching device for selectively connecting respective said oil filter units into the flow path of the oil to the main oil duct, so as to switch only one proportion of said oil filter units to form at least one active oil filter unit to be traversed by a flow of the oil, and to switch another proportion of said oil filter units to form at least one passive oil filter unit not to be traversed by a flow of the oil;

a switching unit connected in the flow path from said oil reservoir to said oil filter units, said switching unit, when said filter switching device is set to switch a proportion of said oil filter units into an active state and another proportion of said oil filter units into a passive state, opening up a first pressurized oil flow path from said oil reservoir to said active oil filter unit and also forming a second drainage flow path between said passive oil filter unit and a drainage duct, with said drainage duct being assigned a drainage device for draining the oil that has accumulated in a region of said passive oil filter unit.

2. The oil supply device according to claim 1, wherein said drainage device is a suction device configured for evacuating the oil from said passive oil filter unit.

3. The oil supply device according to claim 1, wherein said drainage duct formed as an evacuation duct is assigned an ejector pump device forming an evacuation device, by way of which the oil that has accumulated in the region of said passive oil filter unit can be evacuated via said evacuation duct, and wherein evacuation pressure is generated by subjecting said ejector pump device to a pressurized oil partial flow branched off from the pressurized oil flow path.

4. The oil supply device according to claim 3, wherein said ejector pump device is permanently actuated during an operation of the internal combustion engine.

5. The oil supply device according to claim 3, wherein said ejector pump device is an ejector pump to be activated at defined times by way of an actuating device.

6. The oil supply device according to claim 3, wherein a branch duct branches off from a flow duct forming the pressurized oil flow path of the pressurized oil flow path, which branch duct opens into said ejector pump device.

7. The oil supply device according to claim 6, wherein said branch duct branches off from a flow duct or flow duct portion, which leads from the delivery device to the switching unit, of the pressurized oil flow path, which branch duct opens into said ejector pump device in a region of a nozzle of said ejector pump device.

8. The oil supply device according to claim 6, wherein said branch duct is at least partly formed in said switching housing.

9. The oil supply device according to claim 6, which comprises a switchable cut-off device disposed at said branch duct and configured to be switched between positions in which said cut-off device opens up or closes off the flow connection to said ejector pump device.

10. The oil supply device according to claim 9, wherein said switchable cut-off device is a controlled cut-off valve.

11. The oil supply device according to claim 9, wherein said switchable cut-off device is coupled to said adjusting device of said switching unit such that, at defined switching positions of said adjusting device said cut-off device can be placed into the positions for opening up or closing off the flow connection to said ejector pump device.

12. The oil supply device according to claim 11, wherein said adjusting device is also configured and/or adjustable such that, during the operation of the internal combustion engine, said adjusting device can be adjusted into a position in which one proportion of said oil filter units is switched into an active state and another proportion of the oil filter unit is switched into a passive state, and in which said drainage device is not activated.

13. The oil supply device according to claim 12, wherein said adjusting device is movable into a position in which said drainage device is not activated, even if a flow connection is produced between the at least one oil filter unit and the drainage and/or evacuation duct.

14. The oil supply device according to claim 1, wherein said drainage duct empties out into said oil reservoir and the oil evacuated via said duct is received in said oil reservoir.

15. The oil supply device according to claim 1, wherein said switching unit includes an adjusting device mounted in a switching housing of said switching unit so as to be adjustable, wherein oil filter flow ducts leading to said oil filter units open into said switching housing and, there, in defined switching positions of said adjusting device, communicate either with said drainage duct or with said pressurized oil flow duct which proceeds from said delivery device and which likewise opens into said switching housing.

16. The oil supply device according to claim 15, wherein said adjusting device is a switching drum rotatably mounted in said switching housing.

17. The oil supply device according to claim 15, wherein said evacuation device is an ejector pump device disposed in said switching housing and, at a switching housing side, is flow-connected to said evacuation duct, which at least in regions forms a constituent part of said switching housing.

18. The oil supply device according to claim 17, wherein said ejector pump device is flow-connected to said evacuation duct in such a way that a nozzle of said ejector pump device projects into said evacuation duct.

19. The oil supply device according to claim 15, wherein:

in a first switching position of said switching unit, said adjusting device connects at least one first oil filter flow duct leading to at least one active first oil filter unit, to a pressurized oil flow duct by way of a first control duct, while at least one second oil filter flow duct leading to at least one passive second oil filter unit, is flow-connected to said drainage duct by way of a second control duct;

in a second switching position of said switching unit in which said at least one second oil filter unit is active and said at least one first oil filter unit is passive, said adjusting device connects the at least one second oil filter flow duct leading to the active second oil filter unit, to a pressurized oil flow duct by way of said second control duct, while the at least one first oil filter flow duct leading to the at least one passive first oil filter unit, is flow-connected to said drainage duct by way of said first control duct.

20. The oil supply device according to claim 19, wherein said adjusting device is a switching drum formed with said first and second control ducts wherein, in the first switching position, said first control duct connects the pressurized oil flow duct to said first oil filter flow duct while said second control duct connects said second oil filter flow duct to said drainage duct, and wherein, in the second switching position, said first control duct connects said first oil filter flow duct to said drainage duct while said second control duct connects said second oil filter flow duct to said pressurized oil flow duct.

21. The oil supply device according to claim 15, wherein said adjusting device is configured to enable all of said oil filter units to be switched into an active state and to be traversed by a flow of oil.

* * * * *